US005636488A

United States Patent [19]

Lawrence et al.

[11] Patent Number: 5,636,488

[45] Date of Patent: Jun. 10, 1997

[54] PANEL AND CLIP ARRANGEMENT

[75] Inventors: David J. Lawrence, Parramatta; Christopher L. Healy, Mount Kuring-Gai; Robert C. Labbett, Quakers Hill, all of Australia

[73] Assignee: Stramit Corporation Limited, Melbourne, Australia

[21] Appl. No.: 309,748

[22] Filed: Sep. 21, 1994

Related U.S. Application Data

[63] Continuation-in-part of Ser. No. 263,619, Jun. 22, 1994.

[30] Foreign Application Priority Data

Jun. 23, 1993 [AU] Australia ..... PL9580

[51] Int. Cl.[6] ..... E04B 7/00; E04D 3/363

[52] U.S. Cl. ..... 52/521; 52/522; 52/537; 52/545; 52/551; 52/592.1; 52/506.05; 52/748.1; 52/478

[58] Field of Search ..... 52/478, 489.1, 52/489.2, 521, 522, 536, 537, 544, 545, 551, 592.1, 710–712, 715, 506.05, 746.11, 748.1, 748.11

[56] References Cited

U.S. PATENT DOCUMENTS

| | | | |
|---|---|---|---|
| 3,064,772 | 11/1962 | Clay . | |
| 3,253,375 | 5/1966 | Takehara . | |
| 3,524,292 | 8/1970 | Bottom | 52/522 |
| 3,590,543 | 7/1971 | Heirich | 52/544 X |
| 3,606,720 | 9/1971 | Cookson . | |
| 3,716,958 | 2/1973 | Scrivener . | |
| 3,867,742 | 2/1975 | Austin . | |
| 4,285,182 | 8/1981 | Dinges . | |
| 4,329,823 | 5/1982 | Simpson . | |
| 4,400,922 | 8/1983 | Boyer . | |
| 4,406,106 | 9/1983 | Dinges . | |
| 4,466,224 | 8/1984 | Hague | 52/544 X |
| 4,486,998 | 12/1984 | Hague . | |
| 4,602,468 | 7/1986 | Simpson . | |
| 4,655,020 | 4/1987 | Ginn, Jr. . | |
| 4,914,886 | 4/1990 | Eriksson et al. . | |
| 5,287,670 | 2/1994 | Funaki | 52/544 |

FOREIGN PATENT DOCUMENTS

| | | |
|---|---|---|
| 60651/73 | 9/1972 | Australia . |
| 49043/72 | 11/1972 | Australia . |
| 473 604 | 8/1974 | Australia . |
| 74042/74 | 10/1974 | Australia . |
| 26422/77 | 6/1976 | Australia . |
| 50872/79 | 10/1978 | Australia . |
| 82129/82 | 3/1981 | Australia . |
| 43081/85 | 5/1985 | Australia . |
| 648737 | 9/1962 | Canada . |
| 0 062 756 | 10/1982 | European Pat. Off. . |
| 0 116 525 | 8/1984 | European Pat. Off. . |
| 0 421 727 | 4/1991 | European Pat. Off. . |
| 1 127 497 | 12/1956 | France . |
| 1 391 573 | 1/1965 | France . |
| 22 56 584 | 11/1971 | Germany . |
| 2 248 886 | 8/1972 | Germany . |
| 615772 | 1/1961 | Italy . |

(List continued on next page.)

OTHER PUBLICATIONS

A copy of the Search Report (First Page Only) is enclosed.

*Primary Examiner*—Robert Canfield
*Attorney, Agent, or Firm*—Merchant, Gould, Smith, Edell, Welter & Schmidt, P.A.

[57] ABSTRACT

A clip assembly 20 for concealed fixing of cladding sheets 50, of the type having re-entrant longitudinal ribs 51, 52 has a retaining element 29 for engaging inside a rib of the sheet. The retaining elements includes a fixing portion 31 disposed in a plane transverse to the rib and shaped for snap-fit engagement with a re-entrant portion 59 of the rib. The retaining formations may be disposed along a strap 21 in opposed pairs, with fastening apertures 40 in the strap centrally disposed below each rib. An improved cladding sheet 50 having interlocking male and female end regions 61, 62 is also disclosed.

56 Claims, 5 Drawing Sheets

FOREIGN PATENT DOCUMENTS

| | | | |
|---|---|---|---|
| 0075073 | 1/1954 | Netherlands | 52/478 |
| 132310 | 5/1963 | New Zealand . | |
| 131820 | 1/1964 | New Zealand . | |
| 133561 | 1/1966 | New Zealand . | |
| 148574 | 12/1969 | New Zealand . | |
| 152091 | 6/1970 | New Zealand . | |
| 156267 | 9/1970 | New Zealand . | |
| 158012 | 7/1971 | New Zealand . | |
| 165854 | 6/1973 | New Zealand . | |
| 186621 | 1/1975 | New Zealand . | |
| 169014 | 7/1975 | New Zealand . | |
| 174953 | 8/1977 | New Zealand . | |
| 184149 | 5/1980 | New Zealand . | |
| 86/8825 | 5/1988 | South Africa . | |
| 1 330 005 | 9/1973 | United Kingdom . | |
| 2 240 793 | 4/1990 | United Kingdom . | |
| 2 240 794 | 8/1991 | United Kingdom . | |

PANEL AND CLIP ARRANGEMENT

This is a continuation-in-part of U.S. Ser. No. 08/263,619 filed Jun. 22, 1994.

BACKGROUND OF INVENTION

The present invention relates generally to a cladding system for the concealed fixing of roofing or other cladding sheets and to a clip and cladding sheet for use in such a system.

Throughout the specification, the invention is described with reference to the orientation for use in roof cladding where the plane of the sheets is generally horizontal. This, however, should not be construed as limiting the invention to that orientation, as the cladding may be laid in other orientations. Accordingly, references to a particular orientation is to be construed to encompass these other orientations.

Cladding sheets for concealed fixing have a plurality of longitudinal, re-entrant ribs, with pan sections between the ribs. The edges of the sheets are adapted for interengagement with the adjacent sheets, so that an end rib of one sheet fits over the end portion of the adjacent sheet.

The sheets are typically secured to the roof structure by elongated clips which secure the trailing edge end portion of the previously laid sheet and the end rib and intermediate ribs of the sheet to be laid. The clip has retaining formations spaced along the length thereof to coincide with the rib spacing. An endmost retaining formation of the clip is engaged with the trailing edge portion of the previously laid sheet, with the remainder of the clip extending in the direction of progress, and is fixed to the roof structure. The next sheet is then pressed onto the clip so that the leading edge rib and intermediate ribs are engaged with the retaining formations and the leading edge rib also locks over the trailing edge portion of the previous sheet.

The prior art clips are formed as a strap, which is folded to form a series of humps. The humps have detents for engagement with re-entrant portions of the ribs of the sheet.

SUMMARY OF THE INVENTION

The present invention seeks to provide an improved cladding system.

In a further aim, one aspect of the present invention seeks to provide a clip arrangement which is able to more securely fix the cladding sheet to the roof structure than in prior art arrangements.

In yet a further aim, the present invention seeks to provide a cladding system which is more easily able to be installed than prior art systems.

In a first aspect, the present invention provides a clip for concealed fixing of a cladding sheet to an underlying structure, the clip including a substantially planar base arranged to be mounted to the underlying structure and a retaining element upstanding from the base, the retaining element containing two fixing portions spaced from the base, the fixing portions being in the form of opposed downwardly and outwardly facing abutment surfaces and wherein said retaining element is configured to resist upward flexure of one fixing position towards the other fixing portion.

The base is arranged to be mounted to the underlying structure by any convenient means. Such means may be a fixing location located on the base through which the base may be firmly secured to the underlying structure. Suitable fixing locations are in the form of an aperture, through which a screw or other fixture may be inserted. Preferably a hexagonal head screw is used and the clip is configured to provide a space to enable access for tightening of the screw to the underlying structure.

In a second aspect, the present invention provides a clip for concealed fixing of a cladding sheet to an underlying structure, the clip including a base arranged to be mounted to the underlying structure and a retaining element upstanding from the base, the retaining element being formed from sheet material and including a body portion and two fixing portions spaced from the base, the fixing portions being located on opposing sides of said retaining element and each fixing portion extending outwardly from the body portion of the retaining element from a transition region to form a downwardly facing abutment surface, wherein each transition region extends in a generally upward direction.

The transition region will vary depending on the configuration of the clips and may be in the form of a fold line from which the fixing portion extends, or may be at the location where there is a change in the profile of the sheet material which forms the fixing portion. However, in either case, the applicant has realised that by ensuring that this transition region is arranged in use to be transverse to the general direction of the longitudinal rib, the strength of the clip may be improved from the prior art clips which have a transition region extending along the rib of the cladding sheet. In this way, under high wind conditions where there are high upward loadings on the cladding system, the clip will not tend to unfold along the transition region as was the case in prior art assemblies. Further, these improved strength characteristics are particularly evident if the transition region extends generally in an upward direction as a high proportion of the loading on the clip will extend along the sheet material at this transition region.

Preferably each fixing portion includes an outwardly facing second abutment surface which in use is arranged to engage the interior walls of the rib of the cladding sheet. The second abutment surface assists in aligning the clip correctly within the rib and also assists in inhibiting twisting of the rib under high wind loading. Preferably each fixing portion includes a first and a second planar portion, with both portions arranged to extend in a generally upward direction with the second portion extending transversely from the first portion to form the outwardly facing abutment surface.

Preferably the fixing portion has a lower edge surface which forms the downwardly facing abutment surface of the fixing portion.

In a particularly preferred arrangement, the clip includes a pair of retaining elements extending from the base. Further, preferably the base and the retaining elements are integrally formed from sheet material. Preferably, the sheet material is metal and most conveniently galvanised iron.

In a further aspect, the present invention provides a clip for concealed fixing of a cladding sheet to an underlying structure, the clip including a base and a retaining arrangement, the base being arranged at a fixing location to be mounted to the underlying structure and the retaining arrangement being upstanding from the base and including a plurality of fixing portions, each fixing portion including a downwardly facing abutment surface and wherein the fixing portions are symmetrical about a central axis and the fixing location is substantially on the central axis.

In a preferred arrangement, the clip includes four fixing portions. In a particularly preferred arrangement, the clip includes a pair retaining elements extending from a base, each including two fixing portions. The fixing portions are symmetrical about a central axis and the fixing location is substantially on the central axis. By having a centralised fixing location, eccentric forces acting on the fastening means, the cladding and the underlying structure is inhibited which enhances the performance of the clip. Further, by spacing the fixing portions symmetrically, the performance of a larger clip may be obtained.

In a further aspect, the present invention provides a clip assembly for fixing a cladding sheet to an underlying structure, the assembly including a plurality of clips, and a strap, the strap extending along a longitudinal axis and having a leading edge and a trailing edge spaced along said axis, with said clips being arranged to be secured at predetermined intervals along the strap, wherein the strap is arranged to be aligned with a like strap in end to end configuration and wherein one of said leading or trailing edges includes guide means arranged to receive the other of said leading or trailing edge of a like strap to facilitate correct alignment of the straps.

In the prior art clips the positioning and alignment of the clips had to be individually measured. No such measurement is required for the assembly of the present invention. This is of great practical benefit. With the assembly of the present invention, the location of the straps on which the clip are positioned will determine this spacing. Further, installation of the sheeting is simplified over the prior art as the straps can be easily aligned along the roof structure through use of the guide means. A further advantage is that the strap can be used to press any insulation fitted below the deck.

In a further aspect, the present invention provides a concealed fixing cladding system including a cladding sheet and a clip for securing the cladding sheet to an underlying structure, the cladding sheet have a rib extending along a longitudinal axis and incorporating an interior space bounded by opposing interior walls with each wall incorporating a re-entrant portion having an upwardly facing abutment surface, the clip including a base arranged to be mounted to the underlying structure and a retaining element upstanding from the base and arranged to be receivable within the interior space of the rib, the retaining element being formed from sheet material and including a body portion and two fixing portions spaced from the base, the fixing portions being located on opposing sides of said retaining element and each fixing portion extending outwardly from the body portion of the retaining element from a transition region to form respective downwardly facing abutment surfaces arranged to engage respective ones of the upwardly facing abutment surfaces of the re-entrant portions of the rib, wherein each transition region extends generally in a direction angularly offset to the longitudinal axis of the rib.

Preferably the transition region extends transverse to the longitudinal axis of the rib and more preferably, extends in a generally upwardly direction.

Preferably the cladding system incorporates a clip according to the earlier aspects of the invention and preferably has outwardly facing abutment surfaces engaging the interior of the wall of the rib at a position above the upwardly facing abutment surfaces of the cladding sheet.

Preferably the clip is engagable with the cladding sheet in a snap-fit arrangement.

In yet a further aspect, the invention relates to improvements in the cladding sheet. In particular, the invention provides a cladding sheet of generally planar configuration having spaced apart male and female longitudinal edge regions; the cladding sheet being arranged to be juxtaposed with a like cladding sheet with the female edge region of one sheet overlapping the male edge region of the other sheet to form a longitudinal extending rib at said overlapping edge region, wherein the male edge region being upstanding from the plane of the sheet to form a first rib part, the first rib part having a side portion including a re-entrant zone to provide offset upper and lower side walls interconnected by an intermediate wall, the intermediate wall having opposed upwardly and downwardly facing bearing surfaces and the upper side wall extending from the intermediate wall to the terminal edge of the cladding sheet, the female edge region being upstanding from the plane of the cladding sheet to form a second rib part, the second rib part having opposed first and second side portions interconnected by an apical portion, the first side portion of the second rib part extending from the sheet to the apical portion and the second side portion extending downwardly from the apical portion to the other terminal edge of the sheet, the second side portion including a re-entrant zone to form offset upper and lower side walls interconnected by an intermediate wall having at least one downwardly facing bearing surface, wherein when the female edge region of the cladding sheet is overlapped with the male edge region of a like cladding sheet, the outer surface of the side portion of the male edge region is caused to interlock with the inner surface of the second side portion of the female edge region with the terminal edge of the male edge region being located against or proximate to the upper side wall of the second side portion of the female edge region.

This arrangement has the advantage that the overlap of the sheet material is minimised, thereby minimising wastage and enabling the span of the sheeting to be maximised. Further by reducing the overlap, the interlocking of the edge regions intermediate adjacent roof structures is improved. In prior art arrangements due to flexing of the sheet material, difficulties were encountered in correctly interlocking the edge regions.

Preferably the internal angle between the upper wall and the intermediate wall of the rib is acute. In the known cladding sheets used with known concealed fixing clips, the re-entrant zone of the rib cannot be to pronounced as the cladding sheet will be to difficult to fix the clips. In the internal angle between the upper side wall and the intermediate wall is obtuse in these known sheets. The advantage of the acute angle is a more positive clip action and also a more attractive shadow line giving the roof a greater aesthetic appeal. Further improvements in the shape of the cladding sheet are disclosed in co-pending application AU 67300/94.

According to yet a further aspect, the present invention provides a cladding sheet adapted for laying side by side with similar sheets, said cladding sheet having an underlap portion along one side thereof and an overlap portion along an opposite side thereof so that the overlap portion of each sheet is adapted to overlie the underlap portion of an adjacent similar sheet, said underlap portion having a proximal side which includes an upper side wall and a lower side wall, aid upper and lower side walls being separated by a recess facing said sheet, said recess being defined by a recess-defining formation which includes wall portions extending away from said sheet respectively from the upper extremity of the lower side wall and the lower extremity of the upper side wall, a distal edge of the overlap portion being adapted to end substantially adjacent the recess-defining formation of the adjacent sheet.

A further advantage of this interlocking arrangement is that reduction in the overlap enables the male edge region to be mounted to the clip prior to fastening of the clip to the roof structure. This enables an improved installation procedure to be adopted particularly when the clip assembly including the strap as described above is used and in a further aspect, the invention relates to an improved installation procedure.

In a further aspect, the present invention provides a clip for concealed fixing of cladding sheets of the type having a plurality of re-entrant longitudinal ribs, the clip including means for fastening to an underlying structure and a retaining formation for engaging inside a rib of the sheet, wherein said formation includes a upright tab disposed in a plane transverse to the rib, the tab being shaped for snap-fit engagement with a re-entrant portion of the rib.

BRIEF DESCRIPTION OF THE DRAWINGS

Further preferred embodiments of the invention will now be described with reference to the accompanying drawings, in which.

DETAILED DESCRIPTION OF THE DRAWINGS

Figure 1:
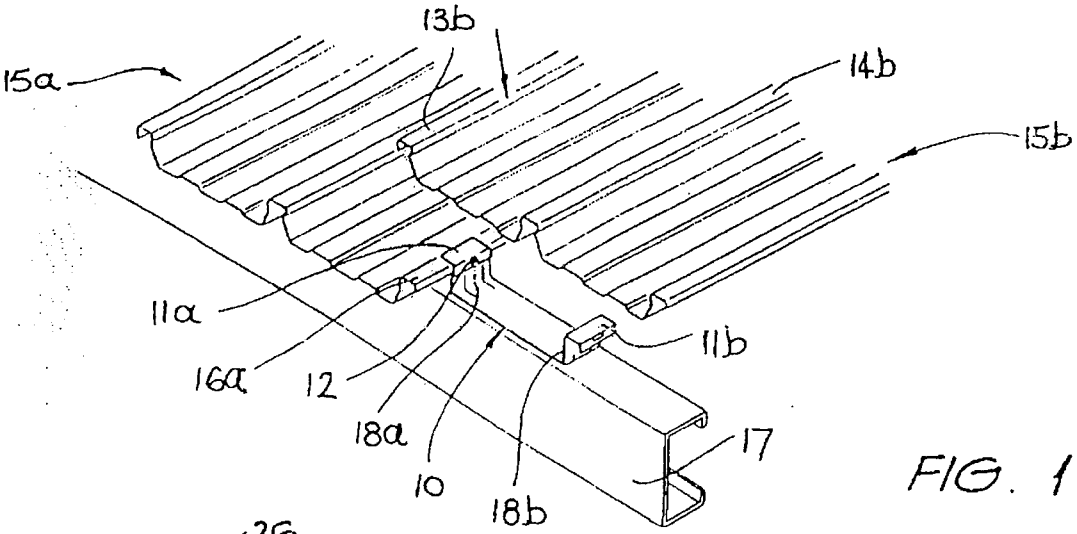
FIG. 1 is a schematic perspective showing installation of a roofing sheet using a prior art clip.

With reference to FIG. 1, the prior art fixing system includes a clip 10 consisting of a flat strap which has been folded along lines 90° to its length to form hump-shaped retaining formations 11*a*, 11*b* at its ends. These formations have detents 12 therein to engage inside the female 13*b* and intermediate 14 ribs of the roofing sheets 15*a*, 15*b*. In use, the first hump 11*a* of the clip is positioned over the male rib 16*a* on the trailing edge of the previously laid sheet 15*a*, and the clip is fixed to purlin 17 by screws at positions 18*a* and 18*b*. The second sheet 15*b* is then positioned with its female 13*b* and intermediate 14*b* ribs over the respective formations 11*a*, 11*b* and is pressed downwards to snap home over the detents 12 and to engage the female rib over the full length of the male rib 16*a*. The procedure is repeated for subsequent sheets, with the male rib of the final sheet being held by a finishing clip.

FIGS. 2 to 5 illustrate a preferred clip assembly according to an aspect of the present invention. The clip assembly 20 includes a strap 21, the strap being elongate and having a leading and a trailing end (22, 23 respectively). The strap 21 is shaped for most of its length as a shallow, downwardly facing channel 24 (as best shown in FIG. 5A). In the region of the trailing end 23 the channel inverts to form an upwards facing channel 25 best shown in FIGS. 4 and 5B. The strap is arranged to be aligned in end to end configuration with a like strap and the channel 25 is configured to enable the leading end 22 of a like strap 21 to be received therein to facilitate alignment of the straps 21.

Three clips 26 are attached to the strap 21 at predetermined intervals. These positions are arranged to correspond to distances between the leading edge rib 51 and to intermediate ribs 52 of the roofing sheet 50 of FIG. 6. Typically the clips 26 are riveted to the strap. However, any other suitable fixing arrangement may be used to locate the clips on the strap 21. As will become apparent later, it is not necessary to secure the clips to the strap as this is achieved on fixing of the clip assembly 20 to roof structure. Consequently, the fixing means for securing the clips to the strap is only required to withstand the loading expected during transportation and installation.

In the illustrated arrangement, each clip 26 is formed as a generally channel shaped element 27 in end view and comprises a base 28 and opposed upstanding retaining elements 29. The retaining elements are formed from sheet material, preferably sheet metal, with each retaining element having a profile generally similar to the profile of the ribs in the rib sheet 50. Each retaining element includes a body portion 30 and a pair of opposed fixing portions 31 which are spaced from the base. The body portion 30 extend across the base and upwardly therefrom and the fixing portion extends from the body portion from an upstanding transition region 32.

Each fixing portion 31 includes first and second planar generally upstanding portions 33 and 34 respectively. The first portion 33 extends outwardly from the transition region 32 and the second portion 34 extends transversely to the first portion. In this way, a pair of downwardly facing shoulders or edge surfaces 43 are formed which are adapted for engagement with the re-entrant portions 53 of the respective ribs of the roof sheet 50. The second planar portion takes the form of an inwardly angled longitudinal flange which incorporate a pair of outwardly facing abutment surfaces 35. The outwardly facing abutment surfaces are arranged to engage the interior surface 54 of the respective ribs. A crown tab 36 in the form of an inwardly turned longitudinal top flange extends from an upper end 37 of the body portion 30 and forms the upper surface of retaining element 29. There preferably is some clearance of the upper surface of the retaining element and the top of the interior 55 of the rib to allow the rib to flex while being snap-fitted onto the clip. Further, an upper edge 38 of the respective fixing portions 31 are spaced from the crown tab 36 to thereby form respective recesses 39 at the upper end 37 of the retaining element 29.

The base 28 includes a fixing location 40. In the illustrated arrangement, the fixing location is in the form of an aperture through which a fastening screw 41 is adapted to be received.

Figure 2:
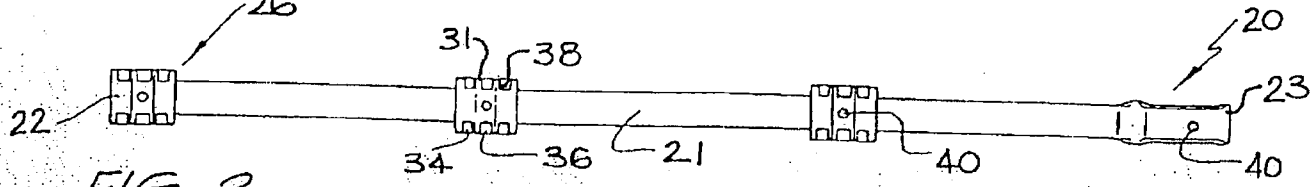
FIG. 2 is a plan view of a preferred clip assembly in accordance with the present invention.
Figure 3:
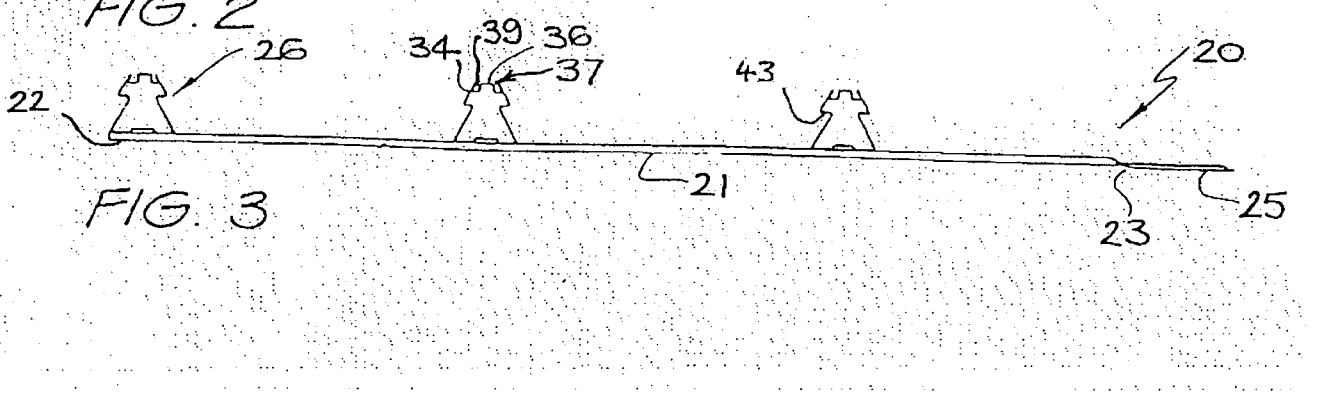
FIG. 3 is a side view of the clip assembly of FIG. 2.
Figure 4:
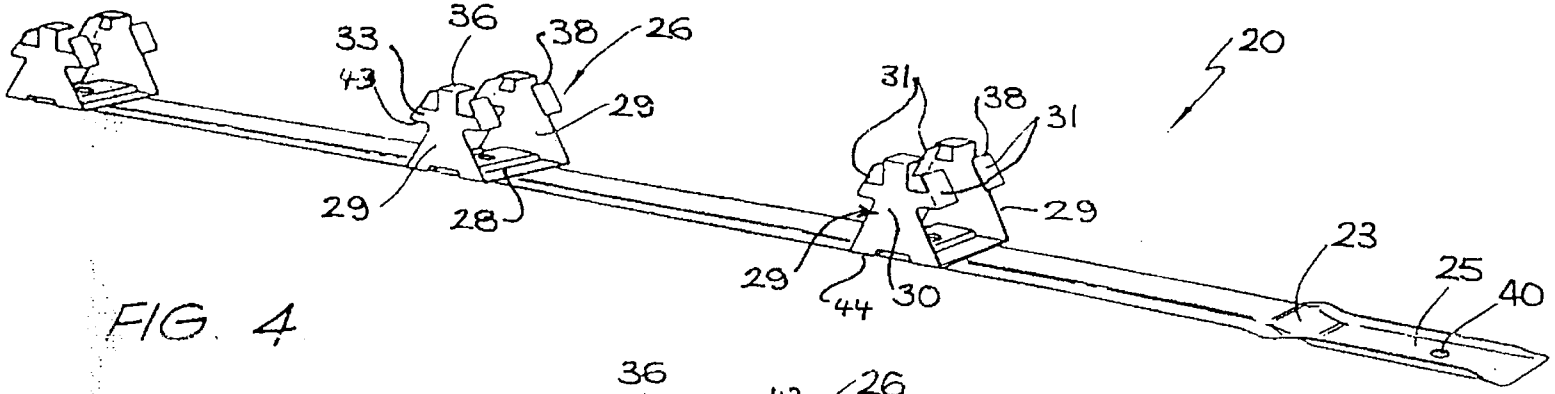
FIG. 4 is a perspective view of the clip assembly of FIG. 2.
Figure 5B:
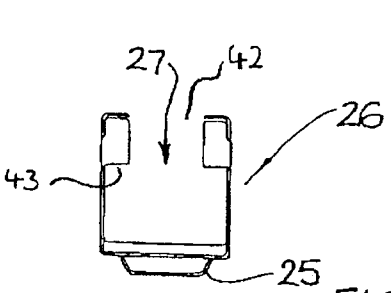
FIG. 5B is a right hand end view of the clip assembly of FIG. 2.
Figure 5A:
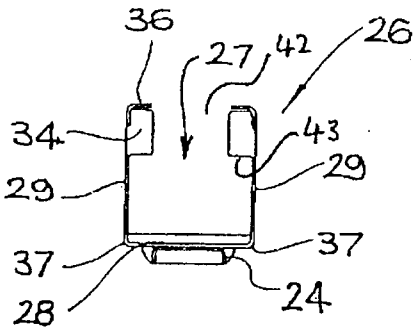
FIG. 5A is a left hand end view of the clip assembly of FIG. 2.

As best seen in FIG. 2, the retaining elements 29 are located on opposing sides of the fixing location 40 and are disposed such that the fixing portions 31 of these elements are substantially symmetrical about the fixing location 40. Further, a space 42 is provided between the retaining elements 29 to enable access to the fastening screw 41 to effect fixing of the clip.

Figure 6:
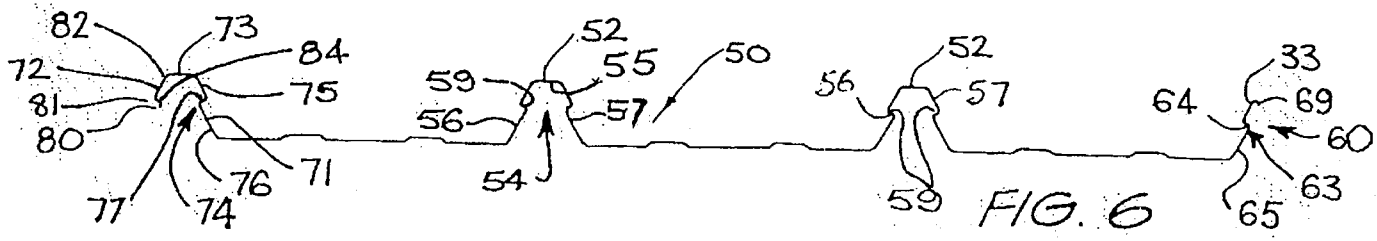
FIG. 6 illustrates the cladding sheet profile for use with the clip assembly of FIG. 2.

FIG. 6 illustrates the profile of the cladding sheet 50. In the illustrated arrangement, the sheet 50 is generally planar and has two intermediate ribs 52. Each rib includes an interior space 54, which is bounded by opposing walls 56 and 57 interconnected by a bridging or apical portion 58. Each wall includes a re-entrant portion 53 to form opposingly upwardly facing abutment surfaces 59.

Furthermore, each sheet 50 includes a male 60 and a female 61 longitudinal edge region. The sheet 50 is arranged to be juxtaposed with a like cladding sheet with the female edge region of one sheet overlapping the male edge region of the other sheet. In this way, a longitudinal rib is formed at the overlapping edge region.

The male edge region is upstanding from the plane of the sheet and forms a first rib part 62. The first rib part includes a side portion having a re-entrant zone 63 to provide offset upper and lower side walls 64, 65 interconnected by an intermediate wall 66. The intermediate wall has opposing upwardly and downwardly facing bearing surfaces 67, 68 and the upper side wall 64 extends from the intermediate wall 66 to a hooked terminal edge 69 of the cladding sheet 50. The female edge region 61 is also upstanding from the plane of the cladding sheet to form a second rib part 70. The second rib part has opposed first and second side portions 71, 72 interconnected by an apical portion 73. The first side portion extends from the sheet to the apical portion and includes a re-entrant zone 74 to provide offset upper and lower side walls 75, 76 interconnected by an intermediate wall 77. The intermediate wall 77 has opposing upwardly and downwardly facing bearing surfaces 78, 79. The second side portion 72 extends downwardly from the apical portion 73 to the other terminal end 80. The second side portion 72 includes a re-entrant zone 81 to form offset upper and lower side walls 82, 83 interconnected by an intermediate wall 84 having an upwardly and downwardly facing bearing surfaces 85, 86.

As illustrated in FIGS. 7A to 7D, the first clip 20*a* is secured to the purlin 87 by fasteners 41 passing through the fastener holes 40 in the strap between the retaining element of each clip. Securing the clip also compresses the insulation blanket 88.

Figures 7A, 7B, 7C, 7D:
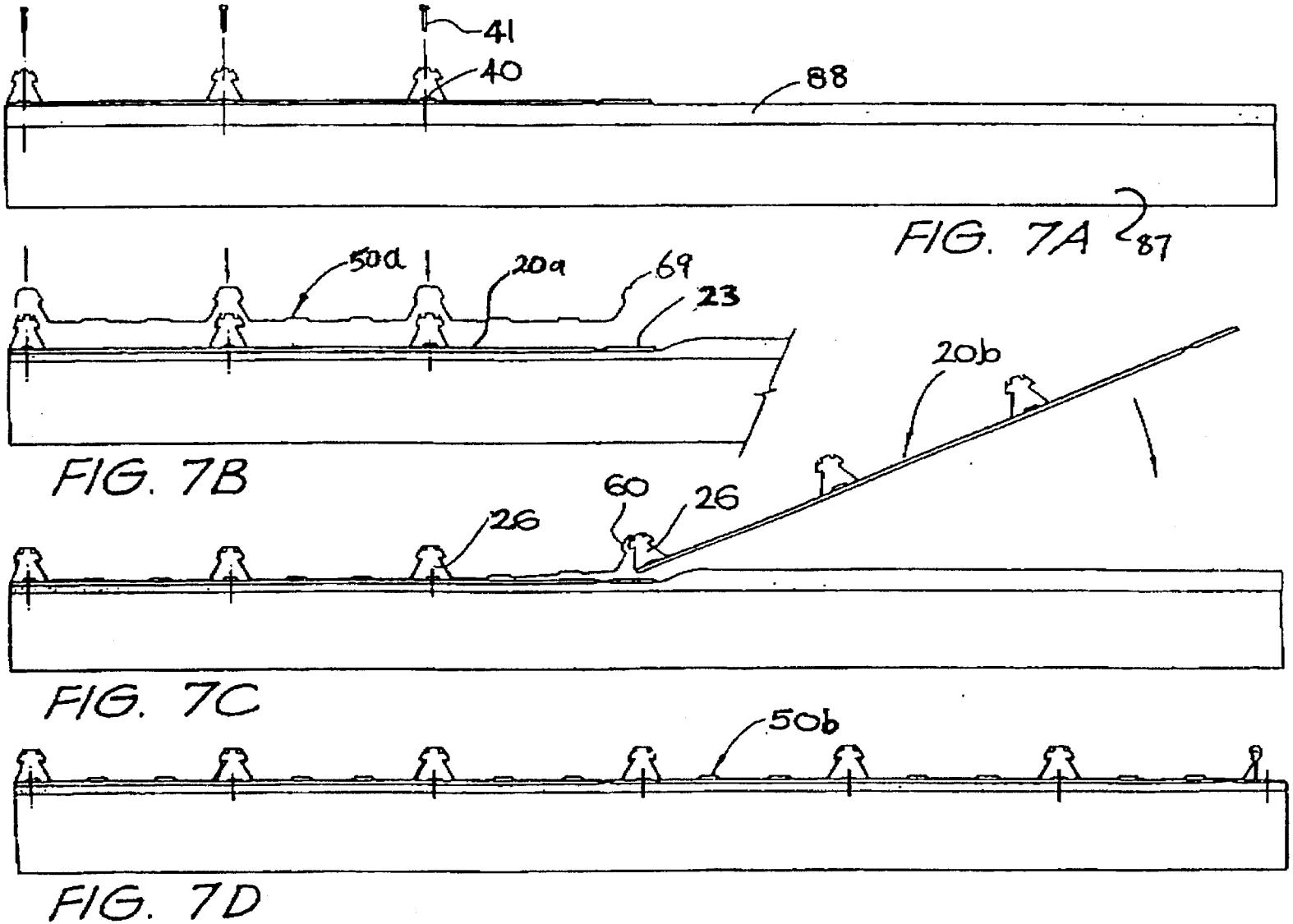
FIGS. 7A to 7D are schematic side views illustrating the installation procedure.

As shown in FIG. 7B, the roofing sheet 50*a* is aligned above the clip assembly 20*a* and pushed downwardly to snap fit the top portions of the ribs over corresponding fixing portions of the retaining elements. Engagement between downwardly facing surfaces 43 of the retaining elements and opposed re-entrant parts 59 of each rib then prevent the sheet from being lifted out of engagement. The outer surfaces 35 of the fixing portions above the surfaces 59 fit tightly inside upwardly convergent top walls 56, 57 of the rib to prevent twisting of the retaining elements.

The next clip assembly 20*b* is installed with the upper edge 38 of the endmost fixing portion 31 hooking under the lip 69 of the trailing edge portion 69 of the previously laid roofing sheet 50*a* such that the terminal end is held within the recess 39. The clip assembly 20*b* is pivoted downwards and secured to the purlin 87 by fasteners 41 passing through fastener holes 40 in the clip (FIG. 7C).

Figure 8:
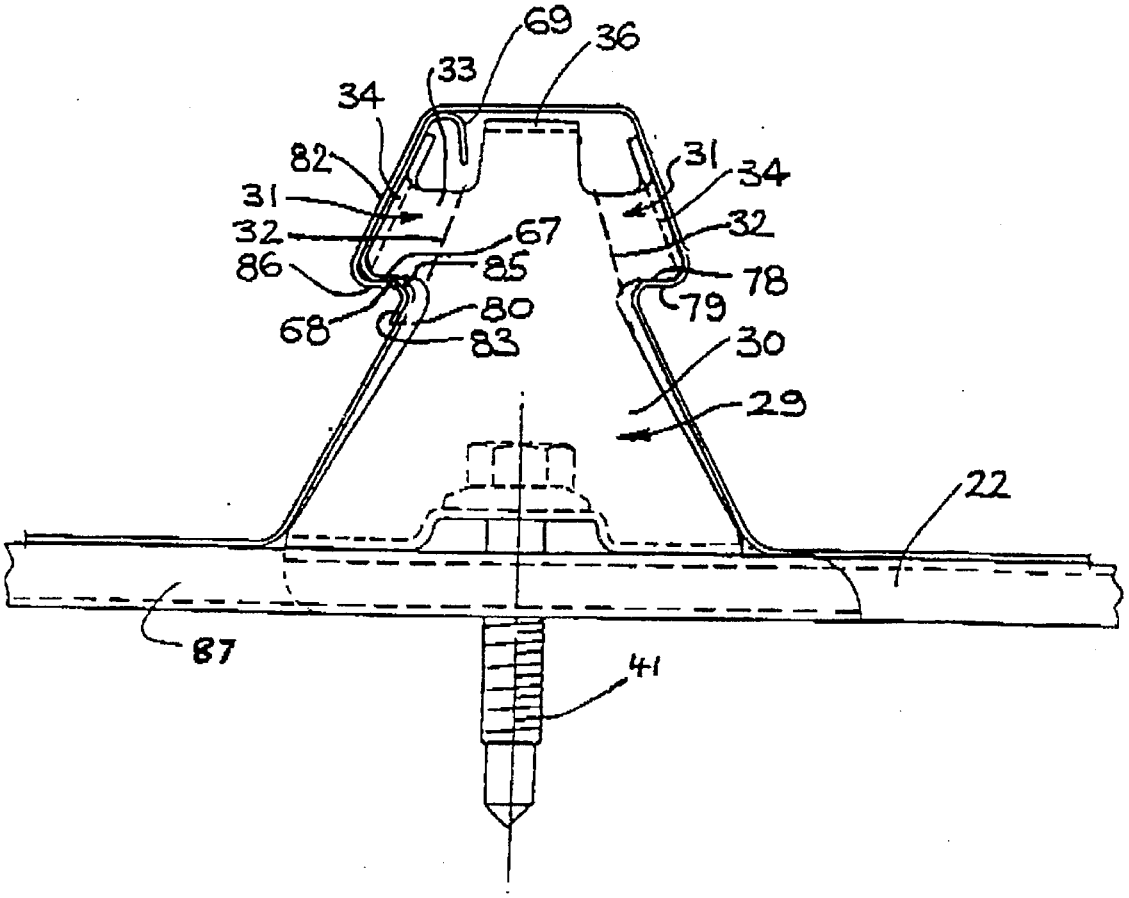
FIG. 8 is a detail side view of a retaining formation of a clip engaged with the leading edge rib of a sheet and the trailing edge portion of the previous sheet.

The next roofing sheet 50*b* is then aligned above clip 20*b* and snapped home as described above for roofing sheet 50*a*, except that the leading female edge rib part 70 snaps over both the endmost retaining formation and the male trailing end rib part 62 of the previous sheet. The engagement between the two clips 20*a*, 20*b* and the two sheets 50*a*, 50*b* is described below with reference to FIG. 8.

Figure 9:
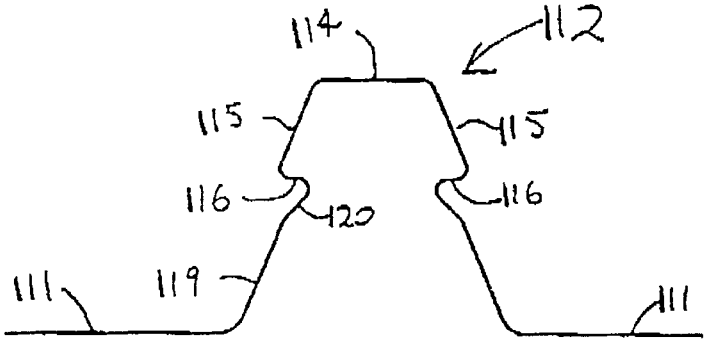
FIG. 9 is an part end view of further embodiment of a roofing sheet according to the invention, showing an intermediate rib dividing adjacent pans.
Figure 10:
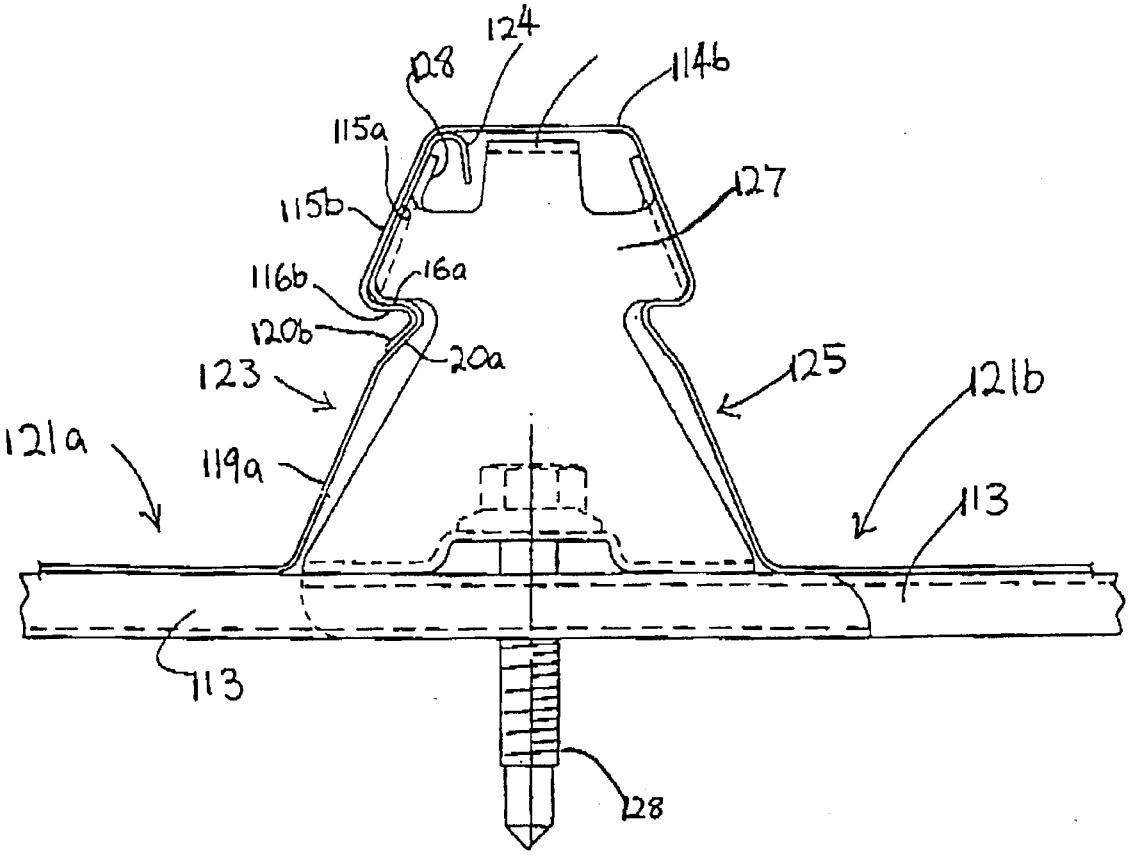
FIG. 10 is an enlarged end view of the overlap between adjacent panels.

FIGS. 9 and 10 illustrate a variation of the cladding sheet. Each cladding sheet consists of a number of horizontal pans 111 divided by longitudinal, hollow stiffening ribs 112. The ribs are re-entrant to allow snap fitting onto clips assembly 113 for concealed fixing to the roof structure.

Each rib has a crown portion formed as a plateau 114, with a pair of downwardly and outwardly extending upper side walls 115 depending from its respective edges.

The base portion of the rib is formed as a pair of lower side walls 119 angled upwardly and inwardly from the pans 111. The lower side walls are substantially parallel to the corresponding upper side wall 115.

The upper 115 and lower 119 side walls are separated by a recess defined by wall portions 116 and 120 angled inwardly relative to the upper and lower side walls. The applicant has found that this configuration creates a shadow region in the area of the recess which creates the favourable visual impression of a taller rib without the use of extra material which would be required to actually create a higher rib.

FIG. 10 shows the overlap of two adjacent panels 121*a*, 121*b* and the clip assembly 113 for concealed fixing of the panels to a roof structure. The tail of the first panel 121*a* has an underlap portion 123 consisting of a lower side wall 119*a*, an upper side wall 115*a* and recess-defining wall portions 116*a* and 120*a*, all shaped in the same manner as the corresponding parts of a stiffening rib 112 as described above with reference to FIG. 9. At the top of the upper side wall 15*a* is a downwardly hooked flange 124.

The overlap portion 125 of the second panel 121*b*, which is snap fitted over the underlap portion 123, consists of a proximal side which again mirrors the side of a stiffening rib 112, a plateau 114*b*, and a distal side with a second upper side wall 115*b* and a distal edge formation having wall portions 116*b* and 120*b* following the profile of the recess-defining wall portions 116*a* and 120*a* of the underlap. The underlap and overlap together form a composite rib profile similar to the intermediate ribs 112.

The clip assembly 113 is substantially the same as that disclosed earlier and the preferred method of installation is the same as that disclosed with reference to FIG. 7A–D and FIG. 8.

By ending the overlap 125 in the region of the recess in the underlap, the edge of the overlap is hidden in the shadow region, the shadowing of which is enhanced by the angling of both wall portions 116 and 120, and thus is less visible. This give a continuous and cohesive appearance to the roof, rather than the individual sheets being visually apparent due to the underlap/overlap detail.

It is to be observed that in one alternative embodiment of the invention, the underlap portion may continue over the clip formation 127 and engage with it at a point beyond the centreline of the formation, so that this underlap will include a proximal portion including the recess-defining wall portions 116*a* and 120*a*, and a distal portion provided with a flange or other formation for engagement with the clip formation 127

As mentioned above, initially the male edge region having the hooked edge is received within the recess 39 of the leading end clip of the next clip assembly 20*b*. This clip assembly is correctly positioned by having the leading edge of its strap received within the guide means of the preceding strap. Once in this position, the side portion of the first rib part of the sheet 50 is engaged with the adjacent fixing portion of the clip such that the upwardly facing bearing surface is located against the downwardly facing abutment surface of the fixing portion of the respective retaining elements and the male edge region is retained in this position by this combined engagement.

Subsequently, the clip assembly 20*b* is pivoted downwards into position. Because the male edge region is located at one edge of the retaining element, the space 42 provided to enable access for the fastening screw is not covered and therefore the clip 26 at the leading end can be fastened to the purlin 87. Once the clip assembly 20 is fastened to the purlin, the next sheet is positioned with the rib part of the female edge end region overlapped with male end region of the preceding sheet. The female region 61 is then snapped home with the outer surface of the side portion of the male edge region interlocking with the inner surface of the second side portion of the female edge region. In particular, the upwardly facing bearing surface of the second rib part engages the downwardly facing bearing surface of the side portion of the first rib part. Furthermore, on the opposing side of the retaining elements the upwardly facing bearing surface of the first side portion of the female edge region is arranged to engage the downwardly facing abutment surface of the fixing portion of the clip.

The illustrated clips and the manner of connection with the projecting edge portion of the sheet allow fasteners to be positioned centrally below the longitudinal rib of the roofing sheet for greater wind uplift resistance and allows direct engagement between the retaining tabs and the leading edge rib. Furthermore, the short trailing edge portion allows greater material efficiency in the roofing sheet compared to the prior art.

The alignment of the retaining elements across the rib profile results in the fold line 44 between the retaining elements and the base 28 of the retaining member being parallel to the clip length, rather than perpendicular as in the prior art. Furthermore, the angled flanges 34 of the fixing portion are closely received in the top portion of the rib, restraining against bending of the clip in both the parallel or perpendicular directions. Consequently, the wind uplift forces acting through the flanges 34 act substantially parallel to the plane of the retaining element. Extreme uplift forces attempt to twist the tab. This mechanism results in considerably greater resistance to wind uplift forces than the prior art hump-shaped retaining formations, in which the uplift forces attempt to unfold the hump by bending along the existing perpendicular fold lines.

As the retaining elements substantially correspond to the rib profile, separate bird proofing accessories are not required.

Unlike prior art clips, the tail 25 of the clip assembly extends past the final clip, thus supporting the full sheet profile and compressing the insulation blanket 88 in the region of connection of the laid sheet with the next clip. This arrangement also allows the head of the next clip to nest within the channel section 25 at the tail of the previous clip, and the alignment of circular fastener holes 40 ensures exact positioning of the clips for correct roof pitching.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

We claim:

1. A clip for concealed fixing of a cladding sheet to an underlying structure, the cladding sheet being of the type including a plurality of ribs extending along the sheet in a longitudinal direction with each rib having re-entrant portions on opposing inner sides of the rib;

the clip being formed from a folded sheet and including a base mountable to the underlying structure and disposed generally in a first plane, at least one retaining element upstanding from the base in a second plane transverse to the first plane, and a first fold line being formed between the base and the retaining element;

the retaining element including opposite edges which upstand from the base, and two fixing portions which project from respective ones of said opposite edges in spaced relationship to said base, each fixing portion including a first portion which extends substantially in the second plane, and a second portion which extends in a third plane which intersects both of the first and second planes, the second portion being joined to the first portion along a second fold line, each fixing portion including a downwardly facing abutment surface which is spaced from the base and an outwardly facing abutment surface which faces outwardly from the other fixing portion; wherein the retaining element is configured such that, in use, when the cladding sheet is presented to the clip for fixing of the sheet to the clip, the clip is aligned with the second plane transverse to the longitudinal direction of the said rib of the sheet and the retaining element is shaped for snap fit engagement with the two re-entrant portions of the rib with the downwardly facing abutment surfaces being adapted to abut against respective ones of said re-entrant portions and the outwardly facing portions being adapted to extend in the longitudinal direction of said rib adjacent to said respective ones of said inner sides.

2. A clip as claimed in claim 1 herein the retaining element includes a planar portion which extends between the fixing portions generally in the second plane.

3. A clip as claimed in claim 2, wherein the planar portion is configured to resist flexure of one fixing portion towards the other in the second plane.

4. A clip as claimed in claim 1, wherein, for each fixing portion, the downwardly facing abutment surface is formed along a lower surface of the first and second portions and the outwardly facing abutment surface is formed along the second portion.

5. A clip as claimed in claim 4, wherein the lower surfaces of the first and second portions form part of respective ones of the edges of the retaining element.

6. A clip as claimed in claim 4, wherein on snap fit engagement of the sheet to the clip, the second portion of each fixing portion is adapted to have its downwardly facing abutment surface disposed in the longitudinal direction of the rib along a respective re-entrant portion, and its outwardly facing abutment surface adjacent to a respective inner side of the rib.

7. A clip as claimed in claim 1, wherein the outwardly facing abutment surfaces of respective fixing portions are inclined upwardly towards each other to facilitate snap fit engagement of the cladding sheet onto the clip.

8. A clip as claimed in claim 1, wherein the outwardly facing abutment surfaces include upper edges which are spaced apart so to form a recess in an upper end of the retaining element.

9. A clip as claimed in claim 1, wherein the retaining element includes an upper end having a crown tab, the crown tab being substantially parallel to said first plane so as to form an upper surface of the retaining element.

10. A clip as claimed in claim 1, wherein the clip is configured such that when in engagement with the rib, the clip provides greater resistance to upward flexure transverse to the rib than it does to flexure in the longitudinal direction of the rib.

11. A clip as claimed in claim 1, wherein the clip includes a pair of said retaining elements upstanding from the base, the retaining elements being spaced apart and being in opposing relationship with their respective first fold lines substantially parallel.

12. A clip as claimed in claim 11, wherein a fixing location, where the clip is adapted to be secured to underlying structure, is provided in said base between said first fold lines.

13. A clip as claimed in claim 12, wherein the fixing location has a centre located substantially at the mid point of a notional line which bisects the respective first fold lines.

14. A clip as claimed in claim 13, wherein the fixing location includes an aperture extending through the base which is adapted to receive fastening means to secure the clip to the underlying structure.

15. A clip as claimed in claim 1, wherein, in use, the clip is adapted to be aligned with the second plane substantially normal to the longitudinal direction of the rib.

16. A clip as claimed in claim 1, wherein the first plane is substantially normal to the second plane.

17. A clip assembly for fixing a cladding sheet to an underlying structure, the cladding sheet being of the type including a plurality of ribs extending along the sheet in a longitudinal direction with each rib having re-entrant portions on opposing inner sides of the rib, the assembly including a plurality of clips and a strap, the strap extending along a longitudinal axis and having a leading edge and a trailing edge, each clip being formed from a folded sheet and including a base disposed generally in a first plane by which the clip is mountable to the strap, a retaining element upstanding from the base in a second plane transverse to the first plane, and a first fold line formed between the base and the retaining element;

the clips being aligned at predetermined intervals on the strap with their respective first fold lines extending in the direction of the longitudinal axis of the strap so that the clips are adapted to engage with respective ones of the ribs with the first fold lines extending transverse to the longitudinal direction of the ribs; and wherein the retaining elements of the clips are configured such that, in use, when the cladding sheet is presented to the clips with said ribs transverse to said first fold lines, each clip is aligned with its second plane transverse to the longitudinal direction of the ribs and is shaped for snap fit engagement with the two re-entrant portions of a respective one of the ribs.

18. A clip assembly as claimed in claim 17, wherein the strap is arranged to be aligned with a like strap in end to end configuration and wherein one of said leading or trailing edges includes guide means arranged to receive the other of said leading or trailing edge of a like strap to facilitate correct alignment of the straps.

19. A clip assembly as claimed in claim 18, wherein the guide means comprises a channel adapted to receive the other edge of said like strap.

20. A clip assembly as claimed in claim 17, wherein the bases of the clips are tack mounted to the strap at said predetermined intervals.

21. A clip assembly as claimed in claim 17, wherein the clip assembly is securable to the underlying structure by fastening means which are engageable with each of the bases of said clips.

22. A concealed fixing cladding system including a cladding sheet and a clip for securing the cladding sheet to an underlying structure;

the cladding sheet being of the type including a plurality of ribs extending along the sheet in a longitudinal direction with each rib having re-entrant portions on opposing inner sides of the rib;

the clip being formed from a folded sheet and including a base mountable to the underlying structure and disposed generally in a first plane at least one retaining element upstanding from the base in a second plane transverse to the first plane, and a first fold line being formed between the base and the retaining element;

the retaining element including opposite edges which upstand from the base, and two fixing portions which project from respective ones of said opposite edges in spaced relationship to said base, each fixing portion including a first portion which extends substantially in the second plane, and a second portion which extends in a third plane which intersects both of the first and second planes, the second portion being joined to the first portion along a second fold line, each fixing portion including a downwardly facing abutment surface which is spaced from the base and an outwardly facing abutment surface which faces outwardly from the other fixing portion; wherein the retaining element is configured such that, when the cladding sheet is presented to the clip for fixing of the sheet to the clip, the clip is aligned with the second plane transverse to the longitudinal direction of a said rib of the sheet and is cooperable with the inner sides of the rib for snap fit engagement of the retaining element with the two re-entrant portions of the rib wherein the downwardly facing abutment surfaces abut against respective ones of said re-entrant portions and the outwardly facing portions extend in the longitudinal direction of said rib adjacent to said respective ones of said inner sides.

23. A cladding system as claimed in claim 22, wherein the retaining element including a planar portion which extends between the fixing portions generally in the second plane.

24. A cladding system as claimed in claim 23, wherein said planar portion is configured to resist flexure of one fixing portion towards the other in the second plane.

25. A cladding system as claimed in claim 22, wherein the outwardly facing abutment surfaces of the respective fixing portions are inclined upwardly towards each other to facilitate snap fit engagement of the cladding sheet onto the rib.

26. A cladding system as claimed in claim 22, wherein, for each fixing portion, the downwardly facing abutment surface is formed along a lower surface of the first and second portions and the outwardly facing abutment surface is formed along the second portion.

27. A cladding system as claimed in claim 26, wherein, the lower surfaces of the first and second portions form part of respective ones of the opposite edges of the retaining element.

28. A cladding system according to claim 22, wherein the clip includes a pair of said retaining elements upstanding from the base, the retaining elements being spaced apart and being in opposing relationship with their respective first fold lines substantially parallel so as to be locatable in spaced relationship within the rib.

29. A cladding system as claimed in claim 28, wherein the base includes a fixing location between said first fold lines, said fixing location being adapted to enable the base to be fixed to the underlying structure.

30. A cladding system as claimed in 29, wherein the fixing location includes an aperture extending through the base which is adapted to receive fastening means to secure the clip to the underlying structure.

31. A cladding system as claimed in claim 22, wherein the cladding sheet includes spaced apart male and female longitudinal edge regions, the cladding sheet being of generally planar configuration and arranged to be juxtaposed with a like cladding sheet with the female edge region of one sheet overlapping the male edge region of the other sheet to form a said longitudinal extending rib at said overlapping edge region;

wherein said male edge region is upstanding from a plane of the cladding sheet to form a first rib part, the first rib part having a side portion including a re-entrant zone to provide offset upper and lower side walls interconnected by an intermediate wall, the intermediate wall having opposing upwardly and downwardly facing bearing surfaces and the upper side wall extending from the intermediate wall to the terminal edge of the cladding sheet; the male terminal edge of the cladding sheet being hooked; and wherein the overlapping edge regions are arranged to be secured to the underlying structure by a said clip with the male edge region being arranged to be located in a retained position with the hooked edge received within a recess located in the retaining element of said clip, the recess being located adjacent an upper edge of the outwardly facing abutment surface of one of said fixing portions of the retaining element; and wherein in said retained position, the side portion of the first rib part is engaged with the one fixing portion such that said upper wall of said first rib part is located adjacent to the outwardly facing abutment surface of the one fixing portion and the upwardly facing bearing surface of said first rib part is located against or approximate to the downwardly facing abutment surface of the one fixing portion.

32. A cladding system as claimed in claim 31, wherein the clip includes a pair of said retaining elements upstanding from the base, the retaining elements being spaced apart, and each having a fixing portion engaging the hooked edge of the male edge region when in the retained position.

33. A cladding system as claimed in claim 32, wherein the base includes a fixing location located between the first fold lines of said pair of retaining elements, the fixing location being adapted to receive fixing means to secure the clip to the underlying structure, the retaining elements being configured to provide a space to enable access to the fastening means, and wherein the male edge region in said retained position is arranged to be remote from said space so as to allow access to said fastening means.

34. A cladding system as claimed in claim 31, wherein the female edge region is upstanding from the plane of the cladding sheet to form a second rib part, the second rib part having opposed first and second side portions interconnected by an apical portion, the first side portion of the second rib part extending from the sheet to the apical portion and the second side portion extending downwardly from the apical portion to the other terminal edge of the sheet, the second side portion including a re-entrant zone to form offset upper and lower side walls interconnected by an intermediate wall having an upwardly facing bearing surface, wherein the female edge region of the cladding sheet is arranged to overlap with the male edge region of a like cladding sheet in the retained position, and wherein the retaining element of the clip is located intermediate the first and second side portions of the second rib part with the outer surface of the side portion of the male edge region interlocking with the inner surface of the second side portion of the female edge region with the upwardly facing bearing surface of the second rib part being arranged to engage the downwardly facing bearing surface of the side portion of the first rib part.

35. A cladding system as claimed in claim 35, wherein the first side portion of the second rib part incorporates a re-entrant zone to provide offset upper and lower side walls interconnected by an intermediate wall having an upwardly facing bearing surface which is arranged to engage the downwardly facing abutment surface of the other fixing portion of said retaining element.

36. A clip for concealed fixing of a cladding sheet to an underlying structure, the cladding sheet being of the type including a plurality of ribs extending along the sheet in a longitudinal direction with each rib having re-entrant portions on opposing inner sides of the rib, the clip including a generally planar base mountable to the underlying structure, and two retaining elements upstanding from the base, the clip being formed from a folded sheet having a first fold line formed between the base and each retaining element, the retaining elements being spaced apart and being in opposing relationship with their respective first fold lines substantially parallel and wherein, in use, when the cladding sheet is presented to the clip for fixing of the sheet to the clip, the clip is aligned so that the first fold lines extend in a plane transverse to the longitudinal direction of a said rib of the sheet with each retaining element shaped for snap fit engagement with the two re-entrant portions of the said rib.

37. A clip as claimed in claim 36, wherein each retaining element includes opposite edges which upstand from the base, and two fixing portions which project from respective ones of said opposite edges in spaced relationship to said base, said fixing portions being locatable within the re-entrant portions of the rib on snap fit engagement of the clip to the sheet.

38. A clip as claimed in claim 37, wherein each retaining element includes a planar portion which extends between the fixing portions generally in a second plane transverse to the plane of the base.

39. A clip as claimed in claim 38, wherein the planar portion is configured to resist flexure of one fixing portion towards the other in the second plane.

40. A clip as claimed in claim 37, wherein each fixing portion defines a downwardly facing abutment surface which is spaced from the base and an outwardly facing abutment surface which faces outwardly from the other fixing portion of the respective retaining element.

41. A clip as claimed in claim 40, wherein each fixing portion includes a first portion which extends substantially in the second plane, and a second portion which extends in a third plane which intersects both of the first and second planes, the first portion being joined to the second portion along a second fold line which is transverse to the first fold line.

42. A clip as claimed in claim 41, wherein, for each fixing portion, the downwardly facing abutment surface is formed along a lower surface of the first and second portions and the outwardly facing abutment surface is formed along the second portion.

43. A clip as claimed in claim 42, wherein the lower surfaces of the first and second portions form part of respective ones of the edges of the retaining element.

44. A clip as claimed in claim 41, wherein on snap fit engagement of the sheet to the clip, each fixing portion of respective retaining elements is adapted to have a portion of its downwardly facing abutment surface disposed in the longitudinal direction of the rib along a respective re-entrant portion, and its outwardly facing abutment surface adjacent to a respective inner side of the rib.

45. A clip as claimed in claim 40, wherein the outwardly facing abutment surfaces of respective fixing portions are inclined upwardly towards each other to facilitate snap fit engagement of the cladding sheet onto the clip.

46. A clip as claimed in claim 40, wherein the outwardly facing abutment surfaces include upper edges which are spaced apart so as to form a recess in an upper end of the respective retaining elements.

47. A clip as claimed in claim 40, wherein each retaining element includes an upper end having a crown tab, the crown tab being substantially parallel to the plane of the base so as to form an upper surface of the retaining element.

48. A clip as claimed in claim 34, wherein the clip is configured such that when in engagement with the rib, the clip provides greater resistance to upward flexure transverse to the rib than it does to flexure in the longitudinal direction of the rib.

49. A clip as claimed in claim 36, wherein a fixing location, when the clip is adapted to be secured to an underlying structure, is provided in said base between said first fold lines.

50. A clip as claimed in claim 49, wherein the fixing location has a centre located substantially at the point of a notional line which bisects the respective first fold lines.

51. A clip as defined in claim 50, wherein the fixing location includes an aperture extending through the base which is adapted to receive fastening means to secure the clip to an upper surface of the underlying structure.

52. A clip for concealed fixing of a cladding sheet to an underlying structure, the cladding sheet being of the type including a plurality of ribs extending along the sheet in a longitudinal direction with each rib having re-entrant portions on opposing inner sides of the rib;

the clip being formed from a folded sheet and including a base mountable to the underlying structure and disposed generally in a first plane, at least one retaining element upstanding from the base in a second plane transverse to the first plane, and a first fold line being formed between the base and the retaining element;

the retaining element including opposite edges which upstand from the base, and two fixing portions which project from respective ones of said opposite edges in spaced relationship to said base, each fixing portion including a downwardly facing abutment surface which is spaced from the base and an outwardly facing abutment surface which faces outwardly from the other fixing portion, the outwardly facing abutment surfaces including upper edges which are spaced apart to form a recess in an upper end of the retaining element; wherein the retaining element is configured such that, in use, when the cladding sheet is presented to the clip for fixing of the sheet to the clip, the clip is aligned with the second plane transverse to the longitudinal direction of a said rib of the sheet and the retaining element is shaped for snap fit engagement with the two re-entrant portions of the rib with the downwardly facing abutment surfaces being adapted to abut against respective ones of said re-entrant portions and the outwardly facing portions being adapted to be adjacent to said respective one of said inner sides.

53. A clip for concealed fixing of a cladding sheet to an underlying structure, the cladding sheet being of the type including a plurality of ribs extending along the sheet in a longitudinal direction with each rib having re-entrant portions on opposing inner sides of the rib;

the clip being formed from a folded sheet and including a base mountable to the underlying structure and disposed generally in a first plane, at least one retaining element upstanding from the base in a second plane transverse to the first plane, and a first fold line being formed between the base and the retaining element;

the retaining element including opposite edges which upstand from the base, and two fixing portions which project from respective ones of said opposite edges in spaced relationship to the said base, each fixing portion including a downwardly facing abutment surface which is spaced from the base and an outwardly facing abutment surface which faces outwardly from the other fixing portion, the retaining element further including an upper end having a crown tab, the crown tab being substantially parallel to said first plane so as to form an upper surface of the retaining element; wherein the retaining element is configured such that, in use, when the cladding sheet is presented to the clip for fixing of the sheet to the clip, the clip is aligned with the second plane transverse to the longitudinal direction of a said rib of the sheet and the retaining element is shaped for snap fit engagement with the two re-entrant portions of the rib with the downwardly faced abutment surfaces being adapted to abut against respective ones of said re-entrant portions and the outwardly facing portions being adapted to be adjacent to said respective ones of said inner sides.

54. A concealed fixing cladding system including a cladding sheet and a clip for securing the cladding sheet to an underlying structure;

the cladding sheet being of the type including a plurality of ribs extending along the sheet in a longitudinal direction with each rib having re-entrant portions on opposing inner sides of the rib;

the clip including a base mountable to the underlying structure and disposed generally in a first plane, and two retaining elements upstanding from the base in a second plane transverse to the first plane, the clip being formed from a folded sheet having a first fold line formed between the base and each retaining element, the retaining elements being spaced apart and being in opposing relationship with their respective first fold lines substantially parallel;

each retaining element including opposite edges which upstand from the base, and two fixing portions which project from respective ones of said opposite edges in spaced relationship to said base, each fixing portion including a downwardly facing abutment surface which is spaced from the base and an outwardly facing abutment surface which faces outwardly from the other fixing portion; wherein the clip is configured such that, when the cladding sheet is presented to the clip for fixing of the sheet to the clip, the clip is aligned with each second plane transverse to the longitudinal direction of a said rib of the sheet with the retaining elements locatable in spaced relationship within said rib and wherein each retaining element is configured to be cooperable with the inner sides of the rib for snap fit engagement of the retaining elements with the two re-entrant portions of the rib wherein the downwardly facing abutment surfaces of each retaining element abut against respective ones of said re-entrant portions and the outwardly facing portions of each retaining element being adjacent to said respective ones of said inner sides.

55. A cladding system as claimed in claim 54, wherein the base includes a fixing location between said first fold lines, said fixing location being adapted to enable the base to be fixed to the underlying structure.

56. A cladding system as claimed in claim 55, wherein the fixing location includes an aperture extending through the base which is adapted to receive fastening means to secure the clip to the underlying structure.

* * * * *

UNITED STATES PATENT AND TRADEMARK OFFICE

CERTIFICATE OF CORRECTION

PATENT NO. : 5,636,488

DATED : June 10, 1997

INVENTOR(S) : Lawrence et al.

It is certified that error appears in the above-identified patent and that said Letters Patent is hereby corrected as shown below:

Col. 8, line 55: insert --.-- immediately after "127"

Col. 14, line 7, claim 35: "claim 35" should read --claim 34--

Col. 15, line 17, claim 48: "claim 34" should read --claim 36--

Signed and Sealed this

Ninth Day of December, 1997

*Attest:*

*Attesting Officer*

BRUCE LEHMAN

*Commissioner of Patents and Trademarks*